US005221951A

United States Patent [19]

Sakamoto

[11] Patent Number: 5,221,951

[45] Date of Patent: Jun. 22, 1993

[54] SHEET-FEEDING APPARATUS HAVING SHEET STORING MEANS WITH SHEET REMOVAL FROM EITHER SIDE

[75] Inventor: Kiyoshi Sakamoto, Kanzaki, Japan

[73] Assignee: Sanyo Electric Co., Ltd., Osaka, Japan

[21] Appl. No.: 833,981

[22] Filed: Feb. 11, 1992

[51] Int. Cl.[5] ..... G03G 21/00

[52] U.S. Cl. ..... 355/311; 271/9; 355/72

[58] Field of Search ..... 355/309, 311, 318, 319, 355/72; 271/9, 8.1

[56] References Cited

U.S. PATENT DOCUMENTS 4,553,831 11/1985 Dixon ..... 355/72 X
4,660,963 4/1987 Stemmle ..... 355/72 X
4,730,206 3/1988 Sawada et al. .
4,954,849 9/1990 Koike et al. ..... 355/319
5,052,671 10/1991 Matsuo ..... 271/9

FOREIGN PATENT DOCUMENTS 4-28675 1/1992 Japan .

*Primary Examiner*—R. L. Moses
*Attorney, Agent, or Firm*—Darby & Darby

[57] ABSTRACT

A sheet feeding apparatus which is used for front-loading type copy machines and the like, adapted to store laterally two kinds of sheets either of different sizes and/or of different storing directions in one cassette. The two kinds of sheets are taken out selectively and separately and fed to the copying machine assembly. In a preferred embodiment, the two kinds of sheets are stored in a storing device and each kind is taken out from an opposite side thereof. The sheet-feeding apparatus when used with an image forming apparatus provides for multifunctions such as multiple copying and double-face copying.

20 Claims, 5 Drawing Sheets

SHEET-FEEDING APPARATUS HAVING SHEET STORING MEANS WITH SHEET REMOVAL FROM EITHER SIDE

BACKGROUND OF THE INVENTION

1. Field of the Invention

The present invention relates to a sheet-feeding apparatus for feeding sheets to image forming apparatus such as copying machines, laser printers and plain paper facsimiles and to an image forming apparatus thereof, and more particularly to a sheet-feeding apparatus having improved sheet-feeding cassettes and sheet take-out section thereof and to an image forming apparatus having multifunctions such as multiple printing, double-face printing or the like.

2. Description of Related Art

Heretofore, cassettes used for image-forming apparatus such as copying machines and laser printers to store sheets have been mounted to the apparatus assembly in such a manner that the front end thereof is inserted into a sheet-feeding opening provided to a lateral side of the apparatus assembly and the rear end thereof is protruded beyond the apparatus assembly. Accordingly, the installation space occupied by the apparatus assembly becomes larger by the size of the cassette protrusion.

With the increased recent office automation, the multifunctioning of image forming apparatus has been required such as enlargement, reduction, continuous-page printing, double-face printing and multiple printing. With the increased multifunctioning of image forming apparatus, cassettes having different sheet-storing directions have been required even for the sheets with same size, and the kinds of the size of sheets to be handled are increased, thereby increasing the number of cassettes.

On the other hand, the effective utilization of office floor space has become an important issue, whereby image forming apparatus have been required to have a small installation space in order to save floor and work space.

As a copying machine which reduces installation space and is capable of mounting many cassettes to the machine assembly thereof, a front loading-type copying machine has been developed. In the machine, a plurality of cassettes storing sheets has been mounted to the lower side of the machine assembly in a manner to be taken out of the front, whereby the cassettes do not protrude beyond the machine assembly to minimize the installation area of the machine assembly.

However, an increased number of cassettes mounted in the front loading-type copying machine requires a large space for mounting within the machine assembly. This causes the copying machine to become large and the incorporation of functions used for multiple copying and double-face copying as elements of multifunctioning to become difficult. This interferes with the multifunctioning and systematizing of copying machines. Where all cassettes cannot be mounted in the machine assembly, another space to place some of them becomes necessary thereby installation space. Where some cassettes are placed outside the machine assembly, the exchange of the cassettes mounted in the machine assembly with those placed separately becomes annoying.

The mounting of cassettes in the machine assembly results in the elimination of the space for placing consumables such as sheets and toners previously placed in the lower part of the machine assembly, thereby requiring a new space for them.

In addition, generally, in the front loading-type copying machine, considering the interchangeability in the machine assembly, one size of sheet has been stored in one cassette whose size is of certain dimensions regardless of the size and kind of sheets. As a result, prior art cassettes have a size such that A-3 size sheets can be longitudinally placed with the longer size of sheet taken as the feeding direction, in the case where A-4 size sheets are laterally placed, approximately half of the space in the cassette becomes wasted (dead space) to cause an extremely large loss with respect to the effective utilization of space.

SUMMARY OF THE INVENTION

An object of the present invention is to provide a sheet-feeding apparatus which can utilize effectively the space in cassettes by reducing the dead space in the cassettes and feed a variety of sheets of different sizes with fewer cassettes.

Another object of the present invention is to provide a sheet-feeding apparatus with reduced volume to make it unnecessary to place cassette in another place.

A further object of the present invention is to provide an image forming apparatus which allows multifunctioning with a lesser space.

A sheet-feeding apparatus of the present invention stores two kinds of sheets of different sizes and/or of different storing directions in one cassette, and takes out separately two kinds of sheets. A copying machine which is an image forming apparatus of the present invention incorporates such sheet-feeding apparatus in the machine assembly to perform multifunctioning such an multiple copying, double-face copying and the like.

The above and further objects and features of the present invention will more fully be apparent from the following detailed description with accompanying drawings.

DESCRIPTION OF THE PREFERRED EMBODIMENTS

With reference to drawings showing embodiments, the present invention will be explained hereinafter.

Figure 1:
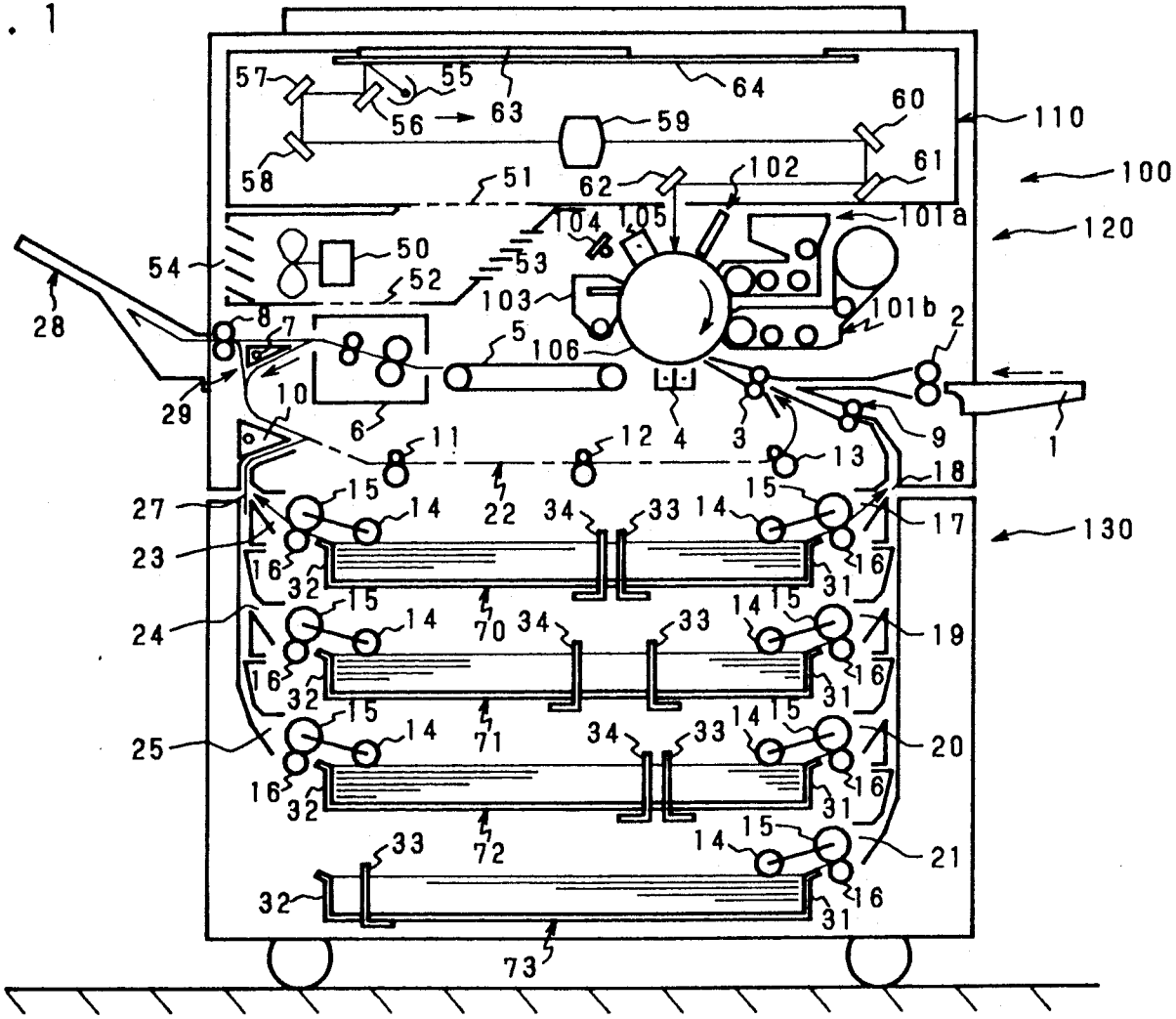
FIG. 1 is a typical longitudinal sectional view showing the structure of a copying machine using a sheet-feeding apparatus of the present invention.

FIG. 1 is a typical longitudinal sectional view showing the structure of a copying machine incorporating a sheet-feeding apparatus in connection with the present invention.

The copying machine has a machine assembly 100 with an optical scanner 110, an image-forming section 120, and a sheet-feeding apparatus 130 of the present invention. The machine assembly 100 is placed on sheet feeding apparatus 130 and feeds sheets to the machine assembly 100. The structure and general operation of the machine assembly 100 will be explained below.

The optical scanner 110 has a light source 55 for exposing an original 63 placed on an original table glass 64, reflecting mirrors 56, 57, 58, 60, 61, 62 for guiding the reflected light from the original 63 to the exposing position on a photosensitive drum 106, and a deforming-magnifying lens 59. The light source 55 and the mirror 56 move in the arrow direction at the same speed as the peripheral velocity of the photosensitive drum 106 during a time of equal magnification to scan the original 63, while the mirrors 57, 58 move at half of the velocity. During reduction, reducing lens 59 changes the position thereof according to magnification (reduction) factor.

The photosensitive drum 106 turns clockwise as shown by the arrow and the surface thereof is coated with a photo-conductive material or provided with a laminated photo-conductive material. On the periphery of the photosensitive drum 106, are disposed a charge corotron 105 for electrically charging the surface of the photosensitive drum 106, an unnecessary-charge eraser 102 for erasing an unnecessary charge, two developing stations 101*a*, 101*b* for allowing toners with different colors to adhere to the photosensitive drum 106, a transfer-separation corotron 4 for transferring a toner to sheets and separating the sheets from the photosensitive drum 106, a blade-type cleaner 103 for removing the toner remaining on the photosensitive drum 106, and a remaining-charge eraser 104 for erasing the remaining charge, in this order along the turning direction shown by the arrow.

The photosensitive drum 106 is electrostatically charged by the charge corotron 105, exposed by exposing and scanning, and forms a latent image by erasing the charge on the exposed area. An unnecessary charge outside the image field or that at composite copying process is erased by the unnecessary-charge eraser 102; a toner is allowed to adhere to the formed latent image by the developing stations 101*a*, 101*b*, whereby the latent image is made a toner formed image. The developed image is transferred by the transfer-separation corotron 4 to a sheet fed with timing taken by a registration roller 3, and the sheet having been transferred is fed through a conveying unit 5 to a fixing unit 6. The fixing unit 6 melts the toner to fix it to the sheet, which is then discharged through a flapper 7 and a discharging roller 8 to a discharging tray 28. The flapper 7, where double-face copying, multiple (composite) copying or the like is performed, is used to feed the sheet to a transmitting path 22 which is described later.

On a side of machine assembly 100, is provided a sheet-feeding base plate 1 for manually inserting and feeding sheets. The sheet to be inserted through the sheet-feeding base plate is usually the one which cannot be fed by the sheet-feeding apparatus 130, and the sheet thus inserted is conveyed by a roller 2 to the registration roller 3.

The above process has been known as an electrophotography process, but the present invention is not limited to this process.

On the bottom of machine assembly 100, is provided two sheet-feeding openings 18, 27. The two sheet-feeding openings 18, 27 are used to take in the sheet fed from the sheet-feeding apparatus 130. The sheet fed from the sheet-feeding opening 18 is conveyed by a roller 9 to the registration roller 3, while the sheet fed from the sheet-feeding opening 27 is conveyed through the transmitting path 22 composed of the flapper 10 and rollers 11, 12, 13 to the registration roller 3.

The registration roller 3 is used to synchronize the sheet with the image formed on the photosensitive drum 106, and starts rotation when the head of the image on the photosensitive drum 106 reaches a specified position.

Reference numeral 50 indicates an air cooler, which sends the outside air introduced from a ventilating opening 54 through air-sending openings 51, 52, 53 to the optical scanner 110, the fixing unit 6 and the photosensitive drum 106, thereby controlling their temperature to a proper value.

The sheet-feeding apparatus 130 of the present invention will be explained below. The sheet-feeding apparatus 130 has a space for housing four cassettes 70, 71, 72, 73, whose outside dimensions are equal to each other and, in the example described, somewhat larger than the size of A-3 sheets. In the area such as Japan where the A-size sheets and B-size sheets are both used two kinds of sheets of A-4 "longitudinal" and A-4 "lateral" are stored in the cassette 70. Here, "longitudinal" means a storing method with which the direction of longer sheet dimension is allowed to coincide with that of sheet-feeding, while "lateral" means a storing method with which the direction of shorter sheet dimension is allowed to coincide with that of sheet-feeding. Usually, "longitudinal" is often used to copy a reduced size image on the sheets, while "lateral" is often used to perform regular copying or double-side copying, composite copying or storing copying.

In the example, in the cassette 71 are stored two kinds of sheets of B-5"longitudinal" and B-5 "lateral", in the cassette 72 are stored two kinds of sheets of B-4 "longitudinal" and A5 "lateral", and in the cassette 73 is stored one kind of sheets of A-3 "longitudinal". Accordingly, seven cassettes have conventionally been required to store such kinds of sheets, while with the present invention, four cassettes having outside dimensions not so different from the conventional ones can store seven kinds of sheets.

Table 1 shows the relation between the cassettes 70, 71, 72, 73 and the size of sheets stored therein. That is, in the above-mentioned embodiment, the combination between each cassette and the size of sheets in the area, such as Japan, where A-size sheets and B-size sheets are mixed during use in disclosed. In the area including Europe where A-size sheets are used mainly and in the area including the U.S.A. and canada where Inch-size sheets are used mainly, the combinations shown in Table 1 are suitable. In this Table 1, the type of copying machine means the placement condition thereof. The copying machine shown in FIG. 1 mounts four cassettes 70, 71, 72, 73 and is placed on the floor, so it is called a floor type. In addition, the number of cassettes is not limited to four, for example, the copying machine, which mounts only two cassettes 70, 71 and can be placed on the desk, is called a desk-top type.

TABLE 1

| Type of Copying Machine | | Cassette | Area where A-size and B-size are used mixedly | Area where A-size is used mainly | Area where Inch-size is used mainly |
|---|---|---|---|---|---|
| Floor Type | Desk-Top Type | 70 | A-4 longitudinal + A-4 lateral | A-4 longitudinal + A-4 lateral | Letter longitudinal + Letter lateral |
| | | 71 | B-5 longitudinal + | A-3 longitudinal | Legal longitudinal + |

TABLE 1-continued

| Type of Copying Machine | Cassette | Area where A-size and B-size are used mixedly | Area where A-size is used mainly | Area where Inch-size is used mainly |
|---|---|---|---|---|
| | | A-4 lateral | | Statement lateral |
| | 72 | B-4 longitudinal + A-5 lateral A-3 longitudinal | A-4 longitudinal + A-5 lateral Sheets used most of A-3, A-4 and A-5 sizes, or Specific sheets such as Forio size in Southeast Asia | Letter longitudinal + Statement Longitudinal Ledger longitudinal |

On the both sides of cassettes 70, 71, 72, and above an end of the cassette 73, are disposed respective pick-up feed rollers 14 for taking out stored sheets, and a pair of sheet-feeding rollers for separation 15 and a pair of reversely-rotating rollers 16 opposite to the respective pick-up feed rollers 14 (see FIG. 1). By pressing sheets by the use of an urging spring through a placing plate 90 (not shown) on the respective pick-up feed feed rollers 14 and generating a friction force for feeding the sheets one by one by the rotation of the respective pick-up feed rollers 14, a sheet conveying force is assigned to the respective pick-up feed rollers 14. Accordingly, if one of the placed sheets is taken out and fed, each sheet-feeding roller for separation 15 and each reversely-rotating roller 16 rotate in the same direction. And if two or more sheets are taken out, each reversely-rotating roller 16 rotates in the reverse direction, and second or more sheets are pressed back to the side of cassettes, and only one sheet in contact with each sheet-feeding roller 15 is separated from the stored sheets and conveyed through sheet-feeding paths 17, 23, 19, 24, 20, 25, 21 to the sheet-feeding openings 18, 27 of the machine assembly 100.

The sheet-feeding equipment utilizing the pick-up feed rollers for taking out sheets and the reversely-rotating friction rollers for separation is described. Next, another embodiment of separation system utilizing segment rollers for take-out and corner fins for separation will be described with reference to FIGS. 2, 3 and 4.

Figure 2:
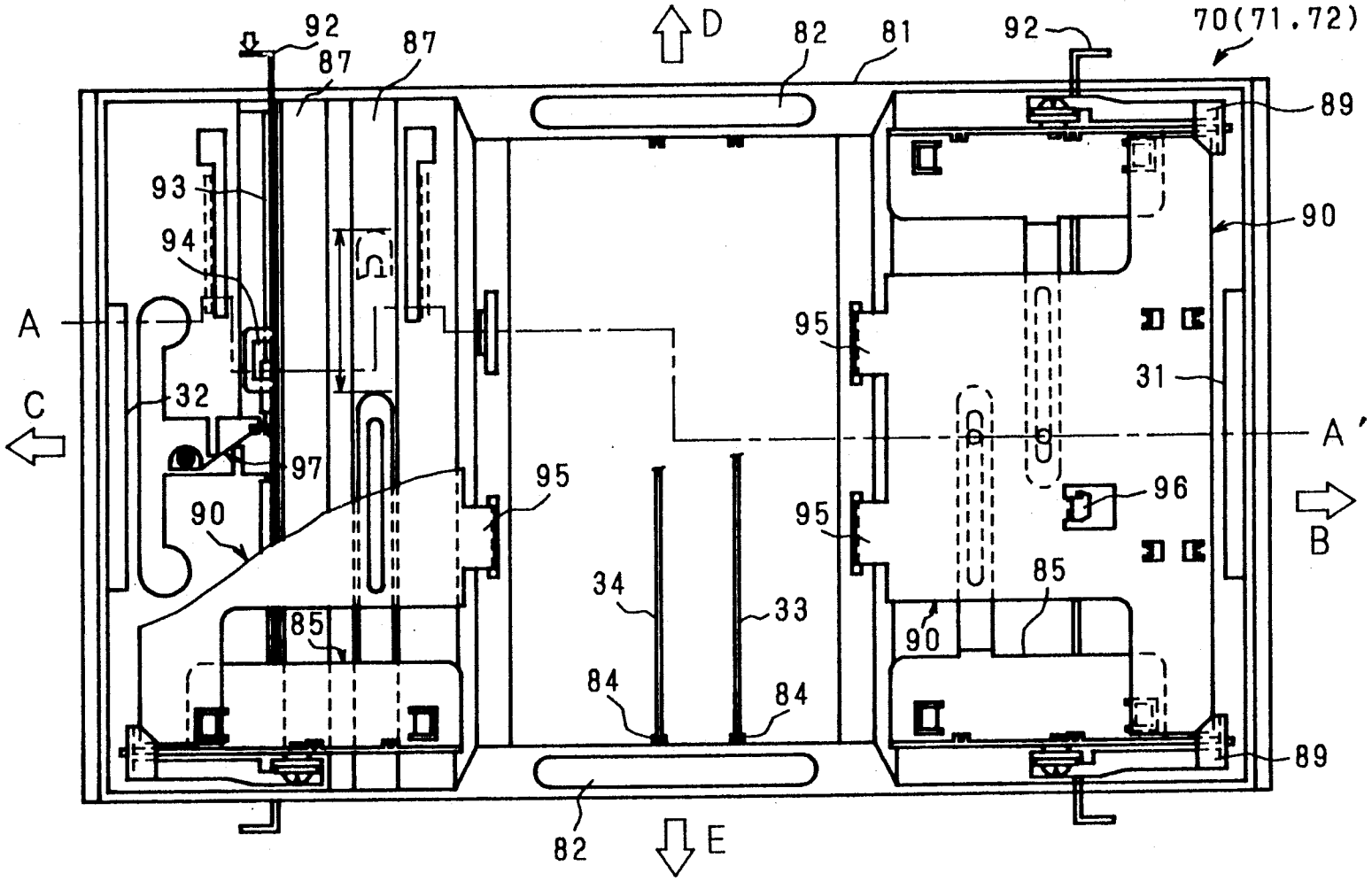
FIG. 2 is a plan view of a cassette in the sheet-feeding apparatus.
Figure 3:
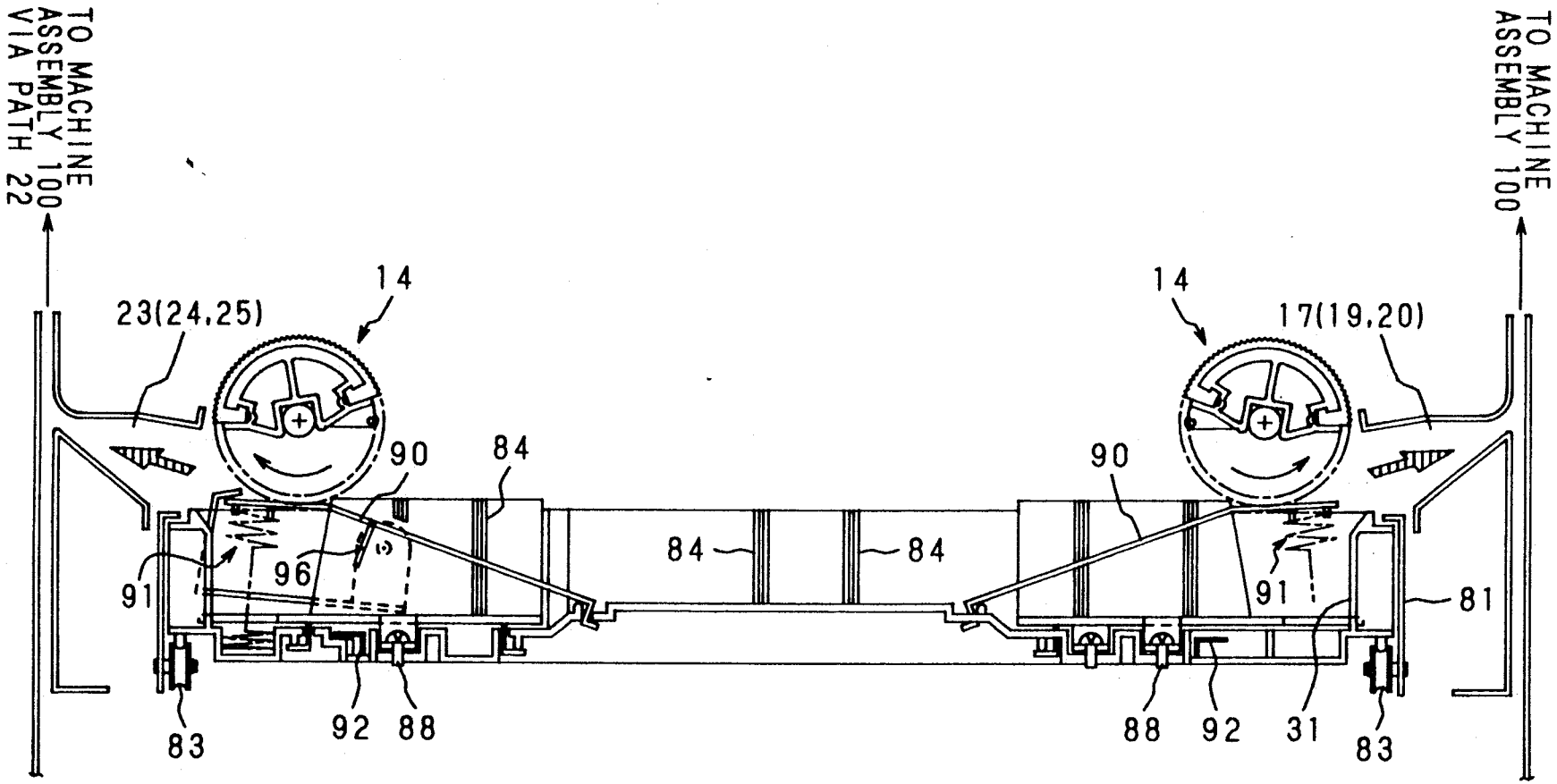
FIG. 3 is a sectional view taken on line A—A' of FIG. 2.

FIG. 2 is a plan view of the cassette 70 (or 71, 72) for storing two kinds of sheets, and FIG. 3 is a sectional view taken on line A—A' of FIG. 2. These cassettes 70, 71, 72 have a similar structure to each other. In FIG. 2, the directions B, C indicate those of feeding of two kinds of sheets, and the directions D, E indicate that of inserting and that of removing of the cassette, respectively.

In FIGS. 2, 3, reference numeral 81 indicates a rectangular case assembly of the cassette 70 (71, 72), and on the both sides in the widthwise direction (direction D–E) of the case assembly 81 are provided handles 82, 82 for mounting/demounting the cassette, while on the both sides in the longitudinal direction (direction B–C) of the case assembly 81 are provided rollers 83, 83 traveling on rails (not shown). By the operation grasping the handle 82 and moving the case assembly 81 in the direction D–E, the cassette 70 (71, 72) can be mounted to or demounted from the sheet-feeding equipment 130.

Near the center of the case assembly 81, a pair of length-controlling plates 33, 34 for making even the sheet lengths in the feeding direction are inserted in guide ribs 84, 84 disposed according to sheet size on the side wall of the case assembly 81. In the widthwise direction of the case assembly 81, two pairs of width-controlling plates 85, 86 for controlling sheet width are fixed with screws 88. The position of the width-controlling plates 85, 86 is adjustable along guide grooves 87 formed in the case assembly 81, whereby the width-controlling plates 85, 86 can be set by the screws to a specified position according to the width of the sheets to be stored. The sheets are stored in the spaces surrounded by the length-controlling plates 33, 34, the width-controlling plates 85, 86, and side plates 31, 32 of the case assembly 81.

Figure 4A:
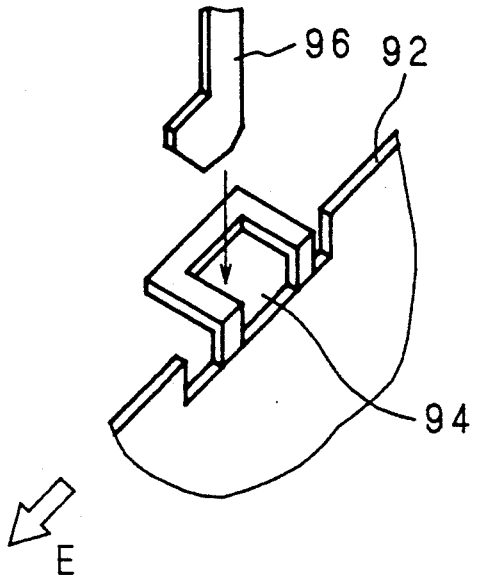
FIGS. 4*a* and 4*b* are a typical views showing the lock mechanism of a sheet placing plate.
Figure 4B:
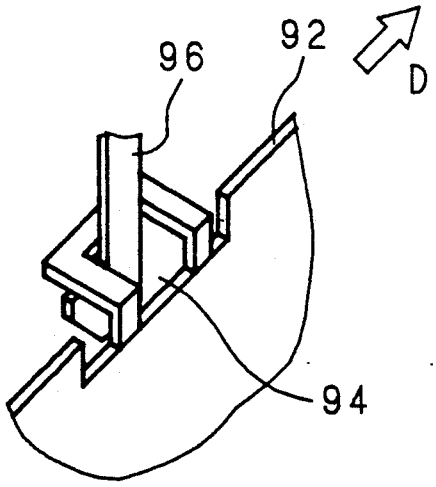

At each corner of the case assembly 81, is disposed a separating fin 89 for separating sheets. In FIGS. 2, 3, reference numeral 90 indicates a placing plate which is connected with an urging spring 91 and places sheets thereon, and 92 indicates a lock plate for the placing plate 90 which is movable in the direction D–E along a guide groove 93 provided on the bottom of the case assembly 81 and urged in the direction D by a spring member 97. The placing plate 90 has a hook 96 extendedly provided downward, and on the center of the lock plate 92, is formed a rectangular hole 94. Urging the placing plate 90 downward causes the placing plate 90 to pivot using a pivot 95 as a fulcrum, and as shown in FIG. 4, the hook 96 of the placing plate 90 to be inserted into the rectangular hole 94 of the lock plate 92 and locked.

The operation of the feeding of sheets of A-4 "lateral" (B-5 "lateral", A-5 "lateral") stored in the cassette 70 (71, 72) will be explained hereinafter.

When the hook 96 is inserted into the rectangular hole 94 and thus in a locked condition, specified sheets are allowed to be placed on the placing plate 90 and stored in the cassette assembly 81. At this point, the lock plate 92 is urged in the direction E at a specified position, whereby the hook 96 is released from the lock plate 92 and the stored sheets are urged by the urging spring 91 against the pick-up feed roller 14. Then, when the copying machine is set to a sheet-feeding mode to rotate the pick-up feed roller 14, the corner of the sheet is caught by the separating fins 89, whereby the sheet-conveying force due to the pick-up feed roller 14 is canceled. A further rotation of the pick-up feed roller 14 causes a deflection between the uppermost sheet and the next one, whereby only the uppermost sheet is fed from the cassette 70 (71, 72). Then, the sheet thus fed is conveyed through the sheet-feeding path 17 (19, 20) and the sheet-feeding opening 18 to the registration roller 3.

Then, the sheet is aligned at the registration roller 3 with the image formed on the photosensitive drum 106, and then the sheet is conveyed between the transfer-separation corotron 4 and the photosensitive drum 106 and a toner image is transferred onto the sheet, and then the toner image is melted to be fixed at the fixing unit 6 and conveyed to the discharging tray 28, whereby a sheet of copy is accomplished.

The operation of the feeding of sheets of A-4 "longitudinal" (B-5 "longitudinal", B-4 "longitudinal") stored in the other side of the cassette 70 (71, 72) will be explained hereinafter. The sheet of A-4 "longitudinal"(B-5 "longitudinal", B-4 "longitudinal") is taken out by the pick-up feed roller 14 in the direction (direction C) reversed by 180° to that (direction B) of feeding of sheet of A-4 "lateral" (B-5 "lateral", A-5 "lateral"), separated by the sheet-feeding roller 15 for separation, the reversely-rotating roller 16, conveyed through the sheet-feeding path 23 (24, 25) and the sheet-feeding opening 27 to the flapper 10 where they are joined with each other in the transmitting path 22 and conveyed to the registration roller 3. Thereafter, a sheet of copy is accomplished in two similar manner to the above.

Although the above-described embodiment employs two methods by which the sheets are separated one by one and fed, the present invention is not limited to these methods.

Having explained a case where the sheets placed in the cassette 70 (71, 72) are separated and fed in the sheet-feeding direction opposite to each other in the above embodiment, for the cassette 70, the same effect can be obtained even if the sheet-feeding direction is the same. In this case, the sheet-feeding path is allowed to be joined to the midway point in the transmitting path 22, in which case the sheet-feeding path becomes shorter than in this embodiment, thereby allowing the first copy to be earlier obtained. In particular, in the area such as the U.S.A. and Canada where Inch-size sheets are mainly used and the area such as Europe where A-size sheets are mainly used, and in the copying machine of desk-top type with two or three cassettes, that effect can be fully accomplished.

In this embodiment, the sheet after being stored can be guided to the transmitting path 22 and conveyed again to the registration roller 3, thereby allowing multiple copying to be performed. Combining this with the developing stations 101*a*, 101*b* and an editor (not shown) allows two-color copying and partially converted color copying to be performed.

In this embodiment, if the sheet after being stored is discharged temporarily by the flapper 7 and the discharging roller 8 to the discharging tray 28, the rear end of the sheet being guided to a double-face copy sheet-passing path 29 by the flapper 7, and the sheet is conveyed through the transmitting path 22 to the registration roller 3 again, the sheet with one face on which the image is copied can be automatically rotated in the reverse direction in the double-face copying process, whereby the double-face copying can be executed.

In the one-cassette, two-paper feeding-type cassette 70 (71, 72) of the present invention as described above, the structure members thereof, that is, the length-controlling plates 33, 34, the width-controlling plates 85, 86, the separating click 89, the placing plate 90, the lock plate 92, the guide rib 84 and the handle 82 are symmetrically arranged with respect to the direction B–C and D–E as shown in FIGS. 2, 3, whereby an effect as described below is obtained. Unlike the above-described embodiment, even where the pick-up feed roller 14 is disposed on one side only, by replacing one inserting direction with the other of one cassette, two kinds of sheets can be fed. For example, in an office where A-3 sheets are not used, replacing the cassette 74 storing A-3 sheets with a one-cassette, two-paper feeding-type cassette allows the copying machine to be more effectively utilized. In the cassettes 70, 71, 72, the lock mechanism for the placing plate 90 is provided to make variable the storing space, whereby either of placing plates 90 is locked so that only one kind of sheet with a large size can also be stored.

The other embodiment of the present invention will be explained hereinafter.

As technical elements required for the multifunctioning of copying machines, particularly, as those relating to the sheet-feeding system, there are multiple copying and double-face copying. Although these technical elements require a space equal to their machine function there is a problem that they are not often used. Accordingly, where these more specialized copyings are not performed, the space for them becomes a dead space, so that providing independently these elements is wasteful with respect to occupied installation space. Considering this point, and making the best use of the features of the present invention that the sheet-feeding mechanism including the pick-up feed roller 14 is provided on the both sides of cassettes, this embodiment is adapted to utilize the transmitting path 22 as a transmitting path for multiple copying and double-face copying, and to replace the uppermost cassette 70 with a tray 74 for multiple copying and double-face copying. The present invention does not provide merely a multi-step sheet-feeding system, but is provides a technique capable of realizing multifunctioning easily.

Figure 5A:
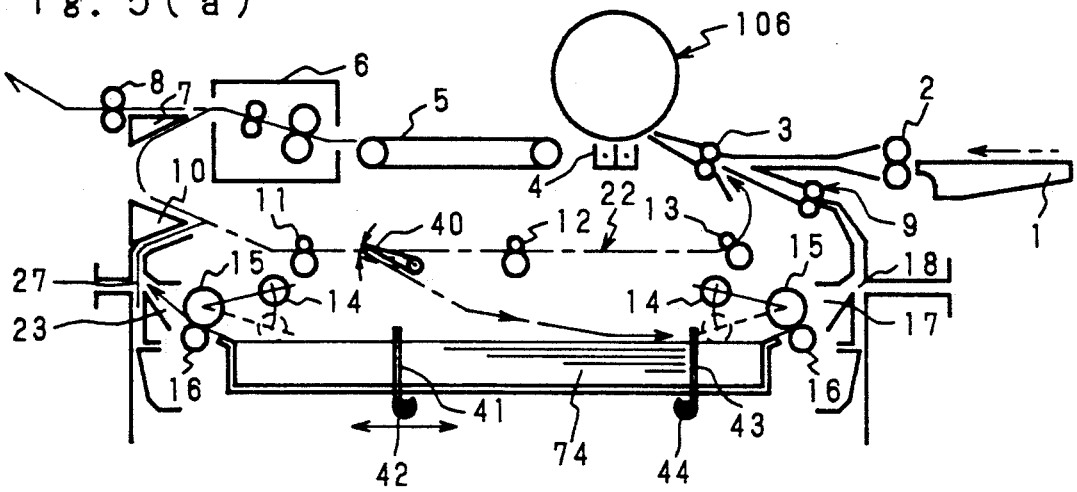
FIGS. 5*a*–5*c* are explanatory views of the structure and operation of the sheet-feeding apparatus.
Figure 5B:
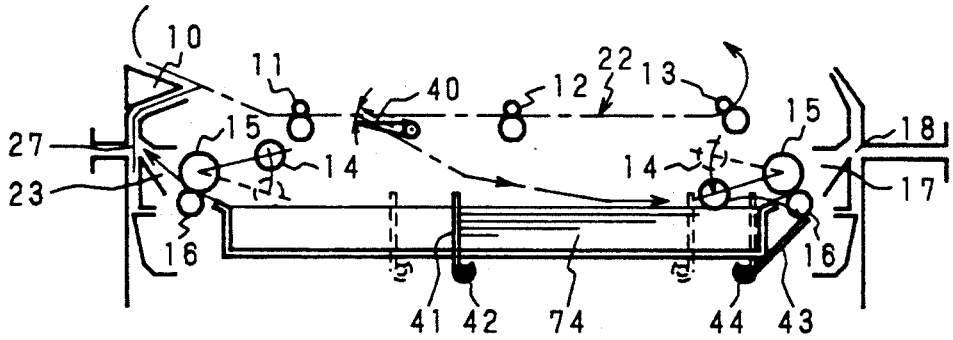
Figure 5C:
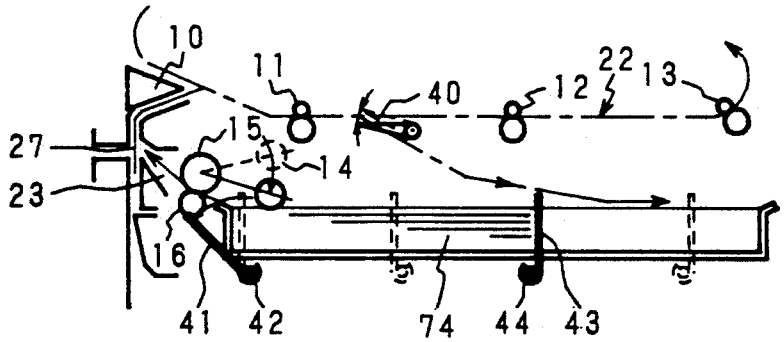

FIG. 5 is a typical longitudinal section view showing the partial structure of a copying machine provided with a sheet-feeding equipment of another embodiment.

As shown in FIG. 5 (*a*), that embodiment is constructed so as to provide a flapper 40 on the middle between the roller 11 and the roller 12 of the transmitting path 22 of FIG. 1 and to change over the flapper 40 to guide sheets transmitted to the transmitting path 22 to the tray 74. The tray 74 has stoppers 41, 43. The stoppers 41, 43 are movable in the longitudinal direction of the tray 74, and pivoted respectively about pivots 42, 44 each of which is engaged with an end of stoppers 41, 43 at the both ends in the longitudinal direction of the tray 74, and extends in the widthwise direction. The stoppers 41, 43 are moved and pivoted by drive means which is not shown. The pick-up feed roller 14 is pivoted at both the position where the roller contacts with sheets and the position where the roller is separated and removed from sheets, and located at the position of removal when sheets are guided by the flapper 40 to the tray 74.

The operation at multiple (composite) copying and double-face copying will be explained hereinafter.

As shown in FIG. 5 (*a*), first the sheet after being stored, which is guided by the flapper 7 to the transmitting path 22 and used as a refeeding sheet, reaches through the flapper 10 and the roller 11 to the flapper 40. The flapper 40 has been changed over to the direction in which the sheet is guided to the tray 74, whereby the sheet is guided by the flapper 40 to abut against the stopper 43 on the tray 74, and stored in the tray 74. At this point, the stopper 41 is adapted to swing leftward/rightward as shown by the arrow each time the sheet is stored in the tray 74 so as to allow the leading edge of the sheet to abut against the stopper 43, whereby the sheet is always stored in a specified position with high accuracy.

When all sheets are stored in the tray 74, for multiple copying, as shown in FIG. 5 (*b*), the stoppers 41, 43 become a pair and move toward the sheet-feeding path 17. Then, when they move to the position where sheets are fed to the copying machine assembly 100, the stopper 43 pivots clockwise about the pivot 44, thereby not obstructing the sheet taken out by the pick-up feed roller 14. The sheets taken out by the pick-up feed roller 14 are separated one by one at the sheet-feeding roller for separation 15 and the reversely-rotating roller 16, and fed through the sheet-feeding path 17 to the copy machine assembly 100 at the sheet-feeding opening 18.

That allows a once-transferred toner image to be overlaid on a plurality of sheets so as to form a toner image. Utilizing this function allows various multiple copyings, for example, image composing to obtain a sheet of image by composing a plurality of originals, and two-color copying to obtain a two-color image.

On the other hand, when all sheets are stored in the tray 74, for double-face copying, as shown in FIG. 5 (*c*), the stoppers 41, 43 become a pair and move toward the sheet-feeding path 23. Then, when they move to the position where sheets are fed to the copying machine assembly 100, the stopper 41 pivots counterclockwise about the pivot 42, thereby not preventing the sheet being taken out by the pick-up feed roller 14. The sheets taken out by the pick-up feed roller 14 are separated one by one at the sheet-feeding roller 15 for separation and the reversely-rotating roller 16, and fed through the sheet feeding path 23 to the machine assembly 100 at the sheet-feeding opening 27. The sheets fed to the machine assembly 100 are conveyed through the flapper 10, then turned out, and through the transmitting path 22 to the regist roller 3. At this point, the flapper 40 pivots counterclockwise and is changed over to the direction in which the sheets pass through the transmitting path 22.

Thus, the sheet-feeding equipment of the present invention has sheet-feeding mechanisms on the both ends of the tray, and allows each sheet-feeding mechanism to feed sheets to the machine assembly 100, whereby multiple copying and double-face copying can be performed by only using selectively the sheet-feeding mechanism with the single tray 74. Furthermore, by making use of the mounting/demounting mechanism such as rollers 83, the tray 74 can be exchanged for the single-function cassette 70 (71, 72, 73).

In the present invention, as described above, two kinds of sheets can be stored and placed in one cassette to be guided to the machine assembly 100. As a result, the number of cassettes becomes significantly fewer than that of prior art one-cassette, one-paper feeding type cassette such that the present invention has, for example, two cassette being half of four cassettes for each A-4 "longitudinal" and "lateral", and letter-size "longitudinal" and "lateral", whereby the present invention can feed six kinds of sheets with four-step sheet-feeding, for example, even where six-step sheet-feeding by prior art cassettes is required.

As a result, in performing specialized multifunction operations, for example, enlargement, reduction, or continuous page copying, the replacement or addition of cassette becomes unnecessary; such functions can be used through one-touch operation; the utility of such specialized functions is much more efficient; the complicated operability in multifunctional copying machines is completely eliminated; and the reduction in the number of cassettes allows the volume ratio in the copying machine assembly of a multistep sheet-feeding apparatus to be lowered. This makes it easy to add technical elements, for example, automatic double-face function and multicopying function required for specialized copying machines.

Further, combining properly large and small sheets in one cassette allows the dead space of the cassette to be eliminated. As a result, the dead space of the copying machine assembly is also eliminated, whereby the space to store changing cassettes and that to store temporarily sheets and toners can be provided in the copying machine assembly, and thus the overall occupied area of a front-loading copying machine be substantially and significantly reduced.

Further, the dead space of cassettes or that of the copying machine assembly is eliminated, and thus sheets are easy to store together in the copying machine assembly, thereby allowing sheets together to be moisture-conditioned. That is, this makes it easy to protect sheets from moisture which is a serious problem for copying machines. For prior art copying machines, sheets cannot be stored together in their machine assembly, so that they have been fed from outside the machine assembly. For the sheet-feeding from outside the machine assembly, an instantaneous moisture conditioning of sheets and feeding of them to the machine assembly requires substantial energy and a number of devices. However, the present invention allows a variety of and a large quantity of sheets to be stored in a condition of sheet-feeding, whereby they can be gradually moisture-conditioned over a long time period. As a result, a small amount of electrical energy allows sheets to be moisture-conditioned and protected from moisture. The moisture conditioning of sheets is easily and inexpensively performed, and almost all of the copying sheets used in a condition of sheet-feeding can be moisture-conditioned, whereby the conveying and transferring properties of sheets are significantly improved. As a result, there is a large improvement of the basic performance of copying machines such that the merits for actual use such as improved reliability of copying machines, extended maintenance interval and reduced service calls are attained, and such that with respect to the economic production of copying machines, reduction of the function for adjusting the potential of copying sheets before being transferred, and elimination of the transfer trouble (such as image bleeding of toner, fringe and poor transfer) are attained.

This embodiment is intended not to provide a single-function, multistep features having two or more kinds of sheets and two or more sheet-feeding features, but to provide a multipurpose, highly-functional and highly-intelligent sheet-feeding equipment which can be used also as a sheet-feeding path for automatic double-face and multiple copying essential to multifunctional and highly functional copying machines by the provision of simple structure and additional functions. As understood from the embodiment, the present invention has a sheet-feeding capability with a very high intelligence, so that adding the capability to a copying machine allows the intelligence of the machine assembly thereof to be enhanced.

Although in this embodiment, the present invention is used as the sheet-feeding equipment of a copying machine, it will be appreciated that the present invention can also be used for all apparatus using a variety of sheets such as laser printers and facsimile machines.

As the present invention may be embodied in several forms without departing from the spirit of essential characteristics thereof, the present embodiment is therefore illustrative and not restrictive, since the scope of the present invention is defined by the appended claims rather than by the description preceding them, and all changes that fall within metes and bounds of the claims, or equivalence of such metes and bounds thereof and therefore intended to be embraced by the claims.

What is claimed is:

1. A sheet-feeding apparatus which feeds rectangular sheets to an apparatus for processing the sheets, comprising:

a single tray means having opposing sides for storing a stack of each of two kinds of sheets either of different sizes or arranged in different storing directions with an edge of the sheets of each stack being adjacent to one of said opposing sides; and take-out means for selectively taking out sheets separately from each stack in a respective different direction from the respective adjacent opposing side of said tray means.

2. A sheet-feeding apparatus according to claim 1, wherein said take-out means comprises a separate means which takes out respectively one of the two kinds of sheets from said storing means.

3. A sheet-feeding apparatus according to claim 1, wherein said storing means has an inner structure of point symmetry.

4. An image forming apparatus, comprising:

means for forming an image on a sheet;

a single tray storing means having opposing sides laterally divided into a first region and a second region each for storing a stack of sheets, sheets from the stack in each region to be fed selectively to said image forming means; and take-out means for selectively taking out separately sheets from the stack in each region from respective opposing sides of said storing means in respective opposite directions to feed said sheets to said image forming means.

5. An image forming apparatus according to claim 4, wherein said storing means stores two kinds of sheets either of different sizes or of different storing directions in said first region and said second region respectively.

6. An image forming apparatus according to claim 5, further comprising a transmitting path for transmitting sheets stored in either of said first region and said second region of said storing means to said image forming means.

7. An image forming apparatus according to claim 4, wherein:

said storing means comprises a plurality of storing cases each for storing two kinds of sheets either of different sizes or of different storing directions in said first region and said second region respectively, and one storing case whose size is substantially the same as that of said plurality of storing cases and which stores only one kind of sheets; and said take-out means takes out selectively twice the number plus one of the number of said plurality of storing cases of kinds of sheets stored in said storing means to be fed to said image forming means.

8. An image forming apparatus according to claim 7, further comprising a transmitting path for transmitting the sheets stored in either of said first region and said second region of said plurality of storing cases to said image forming means.

9. An image forming apparatus, comprising:

image forming means having a developing unit for developing a latent image of an image holding medium, a transferring unit for transferring the image developed by said developing unit to sheets, and a fixing unit for fixing the transferred image;

means for feeding sheets to said image forming means;

a transmitting path for transmitting again the sheets on which an image has been fixed to said image forming means;

means for temporarily storing the sheets on which the image has been fixed;

means for changing over the conveyance of the sheets on which the image has been fixed to one of said feeding means and said temporarily-storing means; and first means for taking out in different directions the sheets stored in said temporarily-storing means.

10. An image forming apparatus according to claim 9, further comprising:

a single tray storing means having opposing sides laterally divided into a first region and a second region, each region storing a stack of sheets from which sheets are to be fed selectively to said image forming means; and second means for selectively taking out separately the sheets stored in each stack of said storing means in respective opposite directions from said tray storing means to be fed to said image forming means.

11. An image forming apparatus according to claim 10, wherein said storing means stores two kinds of sheets to one of different sizes and of different storing directions in said first region and said second region respectively.

12. An image forming apparatus according to claim 9, wherein the sheets taken out in one direction of said temporarily-storing means are fed without passing through said transmitting path to said feeding means, while the sheets taken out in the other direction of said temporarily-storing means are fed through said transmitting path to said feeding means.

13. An image forming apparatus according to claim 12, further comprising storing means, laterally divided into a first region and a second region, for storing sheets for each region to be fed to said image forming means.

14. An image forming apparatus according to claim 13, wherein said storing means stores two kinds of sheets of one of different sizes and of different storing directions in said first region and said second region respectively.

15. An image forming apparatus according to claim 13, further comprising take-out means for taking out the sheets stored in said storing means in the different directions.

16. An image forming apparatus according to claim 15, wherein said storing means stores two kinds of sheets of one of different sizes and of different storing directions in said first region and said second region respectively.

17. An image forming apparatus according to claim 16, wherein the sheets taken out in one direction of said temporarily-storing means and of said storing means are fed without passing through said transmitting path to said feeding means, while the sheets taken out in the other direction of said temporarily-storing means and of said storing means are fed through said transmitting path to said feeding means.

18. A sheet feeding apparatus which feeds rectangular sheets to an apparatus for processing the sheets, comprising:

means having opposing sides and an inner structure of point symmetry for storing a stack of each of two kinds of sheets either of different sizes or arranged in different storing directions; and take-out means for selectively taking out separately in a respective different direction from opposing sides of said storing means each of the two kinds of sheet stored therein.

19. An image forming apparatus, comprising:

means for forming an image on a sheet;

storing means including a plurality of first storing cases each laterally divided into a first region and a second region for storing a stack of sheets in each region to be fed sequentially to said image forming means, each said first storing case storing two kinds of sheets either of different sizes or of different storing directions in said first region and said second region respectively, and one second storing case whose size is substantially the same as that of said plurality of first storing cases and which stores only one kind of sheets; and take-out means for selectively taking out separately the sheets from each region from respective opposing sides of said first storage case to feed said sheets to said image forming means; and said take-out means takes out selectively twice the number plus one of the number of said plurality of first and second storing cases of kinds of sheets stored in said storing means to be fed to said image forming means.

20. An image forming apparatus according to claim 19, further comprising a transmitting path for transmitting the sheets stored in either of said first region and said second region of said plurality of first storing cases to said image forming means.

* * * * *